United States Patent [19]

Stabinsky et al.

[11] 3,999,935

[45] Dec. 28, 1976

[54] COMPACT STEAM GENERATOR IGNITION SYSTEM

[75] Inventors: Leon Stabinsky, Chatsworth, Calif.; James F. Kelly, McLean, Va.

[73] Assignee: Rockwell International Corporation, El Segundo, Calif.

[22] Filed: Mar. 7, 1975

[21] Appl. No.: 556,515

[52] U.S. Cl. ..... 431/121; 431/158; 431/285; 60/39.82 P

[51] Int. Cl.[2] ..... F23D 15/00; F23Q 9/00

[58] Field of Search ..... 60/39.74 B, 39.82 P; 431/284, 285, 157, 158, 121

[56] References Cited

UNITED STATES PATENTS

| | | | |
|---|---|---|---|
| 2,697,482 | 12/1954 | Blizard | 431/158 |
| 2,784,553 | 3/1957 | De Corso et al. | 60/39.82 P |
| 3,915,124 | 10/1975 | Kuhn et al. | 122/115 |

*Primary Examiner*—Carroll B. Dority, Jr.
*Attorney, Agent, or Firm*—L. Lee Humphries; Robert G. Upton

[57] ABSTRACT

Simultaneous ignition of a multi-burner compact steam generator is accomplished through use of a pilot flame that is established in each of the individual burner elements. A hot gas ignition source is generated in a preburner plenum chamber by sparking a fuel/oxidizer mixture. A combustion wave resulting from gases generated within the plenum is distributed to each of the individual main burners through a multiplicity of conduits to ignite a pilot fuel source which is independently fed into each of the burner elements thus providing a pilot flame for subsequent main stage ignition.

5 Claims, 3 Drawing Figures

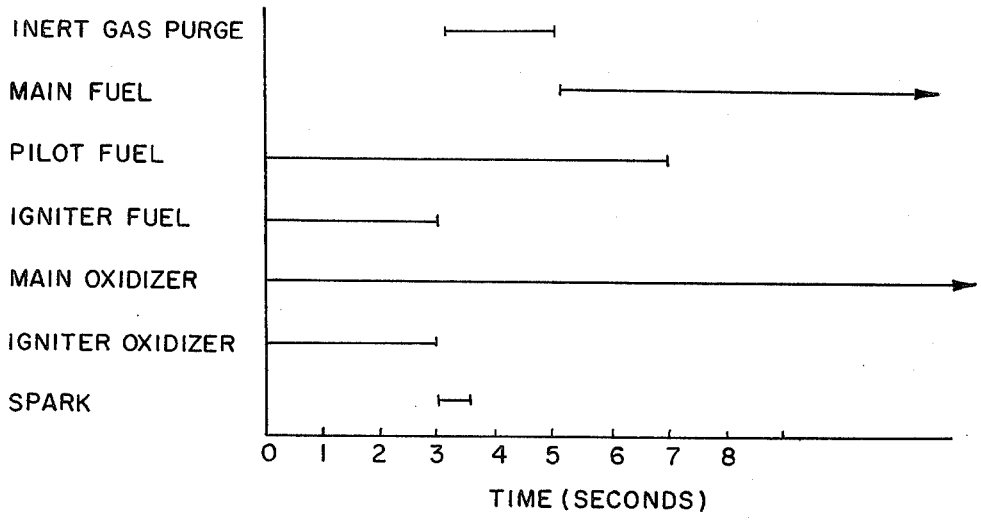
FIG. 1
FIG. 3
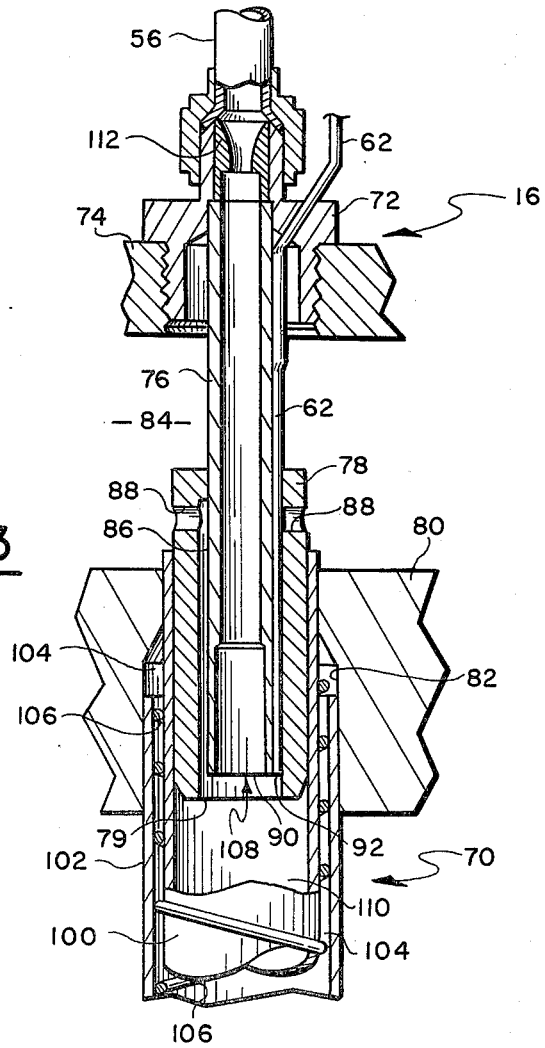

COMPACT STEAM GENERATOR IGNITION SYSTEM

CROSS REFERENCE TO RELATED APPLICATIONS

This disclosure is related to a copending patent application Ser. No. 495,350 filed Aug. 7, 1974, entitled, "Compact High-Pressure Steam Generator" and now U.S. Pat. No. 3,915,124.

BACKGROUND OF THE INVENTION

1. Field of the Invention

This invention is related to the field of fuel-fired steam generators. More particularly, this invention refers to a means to provide multiple ignition of individual pilot lights associated with a multiplicity of individual boiler tube assemblies contained within a housing.

2. Description of the Prior Art

U.S. Pat. No. 3,695,811 describes a pilot and main fuel gas supply means for pressurized gas-fired space heaters or the like. This invention describes a means for supplying pilot and main fuel gas to the fuel gas-combustion air mixing area of a gas-fired heater which employs pressurized combustion means. The pressurized combustion means include an elongate trough having an imperforate base wall and long side walls that are pierced by a plurality of pressurized combustion air inlet apertures and a fuel gas supply conduit which extends generally longitudinally through the trough. The fuel gas supply conduit has a long surface that is pierced by a plurality of apertures through which fuel gas can enter the trough and be turbulently mixed with pressurized combustion air in a fuel-gas-air mixture area defined by the apertured trough side walls and the apertured fuel-gas supply conduit surface, and can be ignited therein to produce an intense flame. The invention describes a pilot and a main fuel gas supply means by installing a partition means which divide the hollow fuel supply conduit into a pilot and a main gas supply portion. Ignition means is provided for the pilot fuel supply source to ignite the pilot fuel thus providing a source of heat for main fuel that is bled through the elongated surrounding tube into the main combustion area. This invention differs from the instant invention in that the pilot fuel and ignition source serves to ignite main fuel in a single combustion chamber.

The present invention provides a single source of ignition for a multiplicity of individual combustion devices thus providing combustion wave ignition for each of the combustors.

Additionally, the present invention differs from the foregoing prior art patent in that a separate source of pilot fuel is supplied adjacent the injector of each combustion device, thus providing a local pilot flame for each combustor that is ignited from a combustion wave from a singular hot gas generator plenum chamber.

U.S. Pat. No. 3,751,210 entitled, "Two-Stage Vaporizing Fuel Oil Burner," assigned to the assignee of the present invention, describes a system similar to the foregoing prior art patent wherein the invention describes a device which achieves vaporization of liquid fuel, such as fuel oil in a "free stream" by burning a small percentage of the fuel on the fringes of a spray of atomized droplets. A small pilot flame is maintained within a housing and is supplied by one of a pair of atomizers to vaporize fuel being injected into the same housing from the second atomizer. The heated chamber within the housing thus vaporizes all the fuel. Both atomizers induce sufficient air through aspiration ports in the housing to premix fuel and air. The fuel ejected from the pilot atomizer experiences a reduction of droplet size through use of a long cone-shaped device which deflects and collects a portion of fuel spray. Gaseous fuel is subsequently burned in a primary combustion chamber downstream of the vaporizing housing. The main difference between U.S. Pat. No. 3,751,210 and U.S. Pat. No. 3,695,811 is that the U.S. Pat. No. 3,751,210 patent preheats a housing which vaporizes through the use of a pilot flame fuel injected into the same housing, the vaporized fuel being subsequently ignited downstream of the vaporizing chamber. The U.S. Pat. No. 3,695,811 patent provides a pilot source by dividing fuel between a main supply source and the pilot fuel supply source. The ignited pilot fuel subsequently ignites the gaseous fuel entering a main combustion chamber through a series of apertures in the main fuel supply source.

The instant invention differs from both of the prior art inventions in that a pilot combustion plenum chamber is provided that consists of a multiplicity of conduits communicating between the pilot combustion plenum and individual combustors in a steam generator device or the like. A combustion wave heat source generated in the combustion plenum chamber propagates down each conduit between the plenum chamber and the individual combustion chambers igniting the pilot fuel therein, thus providing a pilot flame for ignition of fuel and oxidizer that is independently fed to each of the combustors in a multi-combustor device.

The present invention provides a means to ignite a multiplicity of combustors arrayed in a housing, each combustor device is an individual source of heat to convert water to superheated steam, thereby providing many small steam generators for use in driving steam turbines, or the like. The main problem is to provide a source of ignition to simultaneously light each pilot associated with the several combustors in the steam generator apparatus.

As background information, a copending patent application entitled, "Compact High-Pressure Steam Generator," is comprised of a multiplicity of individual burner tube assemblies, each boiler tube is comprised of concentric tubes. The inner tube being essentially a fire tube wherein gaseous fuel and gaseous oxidizer are ignited and combusted, the heat generated thereby radiating through the inner fire tube into an annular chamber formed by the inner fire tube and the outer concentric tube. Water is circulated through the chamber defined by the tube, the water being converted to superheated steam as it exits the opposite end of the tube from the injector. The compact steam generator is comprised of a multiplicity of individual boiler tube units and the problem, as stated heretofore, is to ignite the oxygen and the fuel in each of the fire tubes simultaneously to start the steam generating process. Each injector at one end of the individual boiler tube assemblies has an individual source of pilot fuel such as propane. In order to ignite the pilot fuel adjacent each injector, a source of ignition must be provided to the exit end of the pilot tube. A hot gas generator plenum chamber is provided which is supplied with a source of fuel and a source of oxidizer. The plenum chamber has individual conduits communicating between the plenum chamber and each of the injectors of the boiler tube assemblies. Upon ignition of the fuel and oxidizer in the plenum chamber a hot gas combustion wave is generated and the wave propagates down each of the individual tubes adjacent to the injectors of the boiler tube assemblies, providing a source of ignition to ignite the pilot fuel exiting the end of each of the pilot fuel tubes. After ignition of the pilot fuel adjacent each injector, the hot gas generator plenum chamber providing the initial combustion wave is converted to a main fuel plenum chamber. Each conduit between the plenum chamber and the injector then becomes a main fuel supply source that is subsequently mixed with an oxidizer independently supplied to each of the injectors of each of the multiplicity of fire tube assemblies. The fuel from the plenum chamber and the oxidizer supplied from a separate source then is ignited by the pilot flame previously ignited by the combustion wave from the plenum chamber. After mainstage ignition of each of the individual boiler tube assemblies, the source of pilot fuel can then be shut down, the main stage combustion being self-sustaining.

Therefore, it is an object of this invention to provide a source of ignition for a multiplicity of individual injectors associated with a steam generator or the like.

More specifically, it is an object of this invention to provide a source of ignition to ignite individual pilots that are placed adjacent to separate injectors associated with a multiplicity of boiler tube assemblies to ignite a pilot in each individual injector. The conduit supplying the intitial combustion wave to ignite each pilot adjacent each injector then becomes a conduit to supply the main fuel source to each injector.

An advantage over the prior art ignitor means is the ignition of pilot light fuel in several individual main combustion chambers by utilizing a combustion wave which is generated from a source remote from the pilot fuel source.

Another advantage over the prior art is the ability to utilize a common plenum chamber as a hot gas generator and as a means to provide main fuel or oxidizer to several combustion devices.

Yet another advantage is the ability to ignite simultaneously a multiplicity of pilots associated with individual combustor devices.

The above noted objects and advantages of the present invention will be more fully understood upon a study of the following detailed description in conjunction with the detailed drawing.

BRIEF DESCRIPTION OF THE DRAWING

FIG. 1 is a chart illustrating the sequential operation of the ignition system,

FIG. 3 is a section taken through FIG. 2 illustrating in detail the pilot tube and combustion wave tube adjacent thereto.

BRIEF DESCRIPTION OF THE PREFERRED EMBODIMENT

Figure 2:
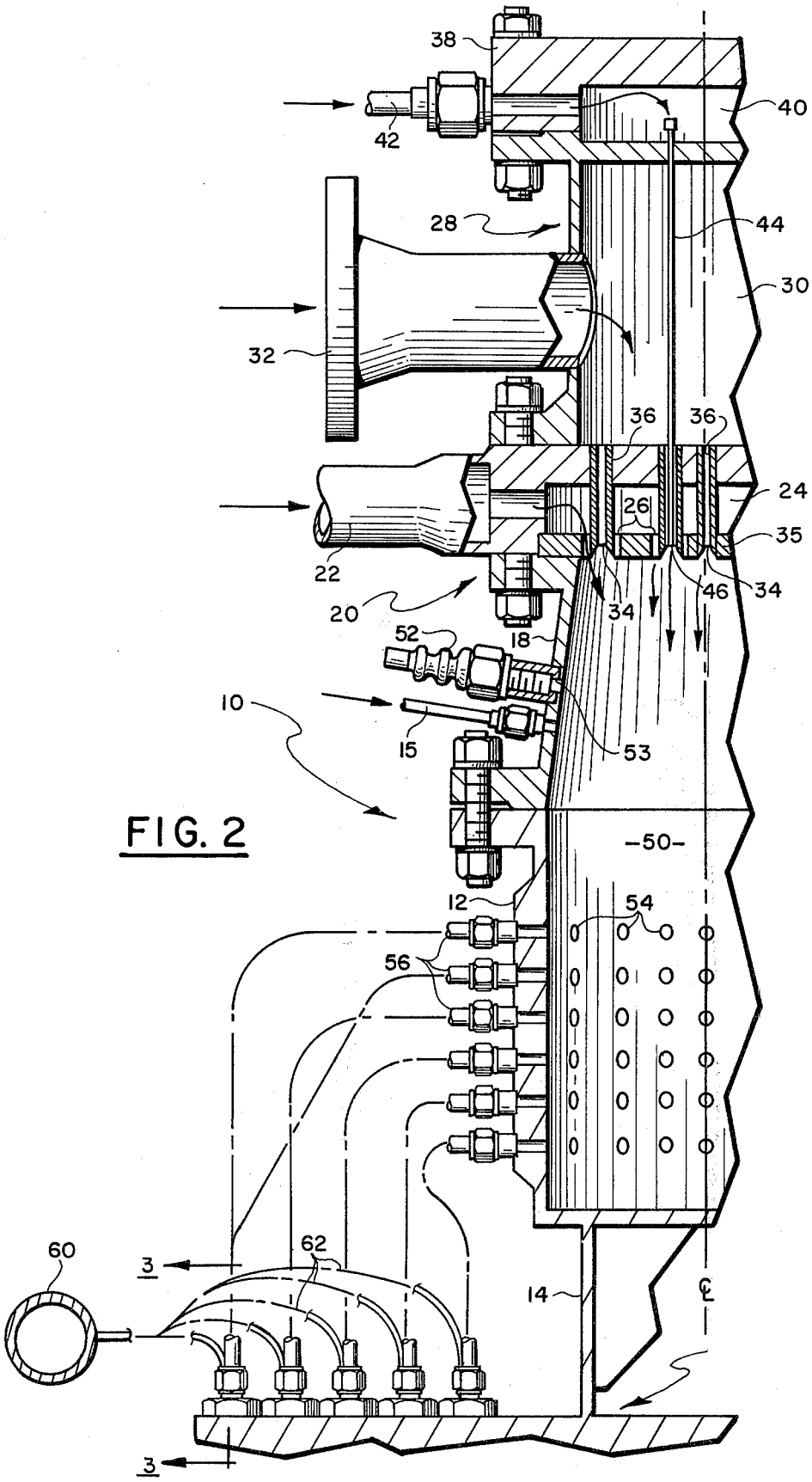
FIG. 2 is a partial cross-sectional view of the hardware associated with the hot gas generator.

Turning to FIG. 2, the combustion wave igniter generally designated as 10 is comprised of a precombustor plenum chamber housing 12. Housing 12 is supported by base 14 which is connected to a steam generator housing end plate generally designated as 16. An intermediate housing 18 is connected to and positioned between housing 12 and oxygen supply manifold generally designated as 20. Connected adjacent the oxygen supply manifold is a fuel supply housing generally designated as 28. The fuel housing 28 defines a main fuel supply chamber 30. The combustion wave igniter apparatus 10 terminates with ignition fuel supply manifold 38. Manifold 38 forms an inner chamber 40. Leading into chamber 40 is an ignition fuel inlet conduit 42.

Combustion wave inlet fuel enters the precombustor combustion wave plenum chamber 50 through a series of ignition fuel supply pipes or conduits 44 which extend through main fuel supply chamber 30 through fuel injection posts 36 that connect to and extend through the oxygen supply manifold 20. The oxygen supply manifold forms an inner chamber 24. Oxygen is fed to chamber 24 through conduit 22 leading therein. Post 36 forms an outer wall which is spaced from and surrounded by openings or injection ports 26 formed by tube sheet 35 of supply manifold 20. It can be seen then that oxygen is bled into chamber 50 through ports 26. Fuel pipe 44 terminates concentrically within post 36, the end 46 of conduit 44 being substantially flush with the end of the post 36. Fuel then mixes with the oxygen passing by ports 26 from manifold 20. Fuel passes through pipe 44 out through end 46 into chamber 50.

At least one source of ignition 52 communicates with the chamber 50 through port 53. Additionally a multiplicity of combustion wave fuel supply ports 54 communicate with each of the individual combustion wave fuel supply conduits 56 which lead to each of the combustion chambers associated with the main steam generator apparatus.

The main fuel supply housing 28 has connected thereto, a main fuel inlet conduit 32. Prior to operation, the main fuel supply source is shut down.

In operation a source of fuel for example, propane is supplied to chamber 40 in the ignition fuel supply manifold 38 through conduit 42. Fuel is metered through the ignition fuel metering pipe or conduit 44 into combustion wave generating chamber 50 through the oxygen supply manifold 20. Simultaneously, oxygen is fed into the oxygen supply chamber 24 through conduit 22 and out through oxygen supply ports 26. The fuel and oxidizer are then mixed within the precombustor chamber 50 prior to ignition. Igniter 52 then ignites this premixed mixture, thus generating an intense source of heat which propogates through ports 54 into conduits 56 down to the pilot fuel supply source to pilot fuel source 60 through conduit 62 and to each of the individual main stage combustors in the steam generator.

After each of the pilots are lit in the main stage combustors, the fuel source for the combustion wave generator which supplies fuel to chamber 40 and the oxidizer source supplying oxidizer to the manifold 20 is shut down.

Chamber 50 combustion wave fuel supply conduits 56 and the fire tube inner combustion wave fuel inlet post 76 are then purged with, for example, an inert gas such as nitrogen sequentially fed into the precombustion chamber housing 18 through conduit 15. After the purging process is completed main fuel is then allowed to enter main fuel inlet conduit 32 into chamber 30 defined by housing 28. The fuel then passes through the fuel injection posts 36 into plenum chamber 50 and out through ports 54 into conduit 56, thus supplying fuel for main stage combustion for each of the multiplicity of combustors in the steam generator.

Turning now to the chart of FIG. 1, the general sequence begins by flowing igniter oxidizer and igniter fuel into the precombustor, and flowing the main oxidizer pilot fuel into the main combustion zone of the fire tube assemblies. After several seconds, the unburned (fuel-rich) gases in the precombustor chamber 50 have reached each of the main tube assemblies, and are detonated by the precombustor spark plug. The detonation or combustion wave travels to each tube assembly and its intense temperature ignites the injector pilot fuel jet with the co-flowing main oxidizer. The igniter flows to the precombustor are then terminated and the residual hot gases of the combustion wave are purged out with an inert gas such as nitrogen. After several seconds, the main fuel valve (not shown) is slowly opened and, as the fuel expels the blanket of inert gas and reached the tube assemblies, it ignites with the pilot fuel and main oxidizer flow. The pilot fuel flow is then timed off, so that only main fuel and oxidizer gases are flowing and burning.

More specifically, in the case where oxygen is used as the oxidizer, propane as the fuel, and nitrogen as the inert gas, the sequence begins, for example, by flowing igniter oxygen and 0.02 lb/sec of igniter propane into the precombustor, (the range may be from 0.015 to 0.025 lb/sec of igniter propane) and flowing a total of 1.9 lb/sec of main oxygen (the range may be from 1.42 to 2.38) and 0.039 lb/sec of pilot propane (the range may be from 0.02925 to 0.04875) into the main combustion zone of the tube assemblies. After approximately 3 sec, (2 to 4 sec), the unburned fuel-rich gases of the precombustor have reached each of the main tube assemblies, and are detonated by the precombustor spark plugs. The detonation or combustion wave travels to each tube assembly and its intense, greater than 4000° F (4000° to 5000° F) temperature ignites the injector pilot propane jet with the co-flowing main oxygen. The igniter flows to the precombustor are then terminated and the residual hot gases of the combustion wave are purged out with an inert gas such as gaseous nitrogen. After approximately 2 sec, (1 to 3 sec) the main propane valve is slowly opened and, as the propane expels the blanket of gaseous nitrogen and reaches the tube assemblies, it ignites with the pilot propane and main oxygen flow. The pilot propane flow is then timed off, so that only main fuel and oxidizer gases are flowing and burning as stated heretofore.

Turning now to FIG. 3, each of the combustion wave-fuel tube feed pipes 56 from the combustion wave igniter 10 communicate with each of the fire tubes 70. The propane pilot light feed tube 62 likewise joins tubes 56 adjacent the injector of each fire tube.

Each of the combustion wave-fuel feed pipes extends through a fuel tube retaining coupling or nut 72, the nut being secured in the oxygen manifold tube sheet 74. The conduit 56 transitions into inner combustion wave-fuel inlet post 76 which extends into an oxygen injection post 78. The oxygen injection post is metallurgically bonded to the water manifold tube sheet 80. Tube sheet 80 has a series of axially aligned openings 82 to accommodate each of the multiplicity of fire tubes 70. Oxygen in chamber 84 enters annulus 86 in injection posts 78 through orifices 88. The annulus is defined by the outer surface of fuel combustion wave post 76 and the inner wall of the oxygen injection post 78. Pilot tube 62 extends through annulus 86 and terminates adjacent face 90 at the base of injection post 76, thus directing propane through opening 92 from source 60 to an area adjacent the point of impingement of fuel and oxidizer to assure ignition of the propellants.

Each of the fire tubes is comprised of an inner combustion tube 100 and an outer tube 102 with an annular space 104 therebetween. An infinitely variable spiral wrap structure 106 separates the inner and outer tubes.

Water is routed within the water tube sheet 80 to the annular space 104 formed by the concentric tubes.

A recessed chamber 108 is formed by terminating end 90 of inlet pipe 76 upstream of end 79 of oxygen injection post 78. The chamber 108 serves as a sort of propellant "premixing" chamber wherein gaseous fuel and gaseous oxidizer are premixed prior to main stage combustion. Better propellant mixing and cleaner burning upon subsequent main stage ignition is thereby achieved. A near stoichiometric mixture is completely combusted in combustion chamber 110. After ignition of the pilot flame by the combustion wave, fuel is metered through conduit 56 by metering jet 112 to supply fuel (or oxidizer) for main stage combustion in combustion chamber 110. Heat is transferred from the inside of the combustion chamber 110 through the walls of tubes 100 of the combustion chamber into the spirally directed water in annulus 104. The extremely high temperature quickly converts water to superheated steam, the steam being directed down the rapidly diminishing angle of the spiral wrap structure 106.

It would be obvious to use different types of fuel and oxidizer in practicing the present invention.

It will, of course, be realized that various modifications can be made in the design and operation of the present invention without departing from the spirit thereof. Thus, while the principal, preferred construction, and mode of operation of the invention have been explained and what is now considered to represent its best embodiment has been illustrated and described, it should be understood that within the scope of the appended claims the invention may be practiced otherwise than as specifically illustrated and described.

We claim:

1. An ignition device to simultaneously ignite a multiplicity of individual main combustors which utilize a fuel and an oxidizer as propellants comprising:

a housing having a base portion at one end and igniter fuel and igniter oxidizer supply manifolds positioned at the opposite end, said housing forming a precombustor plenum chamber, said fuel and said oxidizer manifolds being in communication with said precombustor plenum chamber, a multiplicity of combustion wave-fuel conduits in communication with said plenum chamber, each of said conduits leading to each of said individual main combustors, said combustors having a separate supply of main oxidizer propellant, at least one igniter means connected to said housing in communication with said precombustor plenum chamber, a multiplicity of pilot fuel conduits that direct a source of pilot fuel to an injector associated with each of said individual combustors, means to meter a supply of fuel and oxidizer into said precombustor plenum chamber from said fuel and oxidizer manifolds where subsequent ignition by said at least one igniter means in said plenum chamber creates an intense heat source in said plenum chamber that propagates in a combustion wave through each of said combustion wave-fuel conduits communicating between said plenum chamber and said multiplicity of individual main combustors thereby providing a source of ignition for said pilot fuel, a source of inert purge gas being subsequently directed into said precombustor plenum chamber to purge said combustion wave-fuel conduits prior to direction of fuel through said conduits, and said precombustion plenum chamber subsequently serves as a main fuel supply source when said oxidizer supply source is cut off after ignition of said pilot fuel, said source of pilot fuel is cut off after steady state operation of said main combustor is achieved.

2. The invention as set forth in claim 1 wherein prior to ignition from 1.42 to 2.38 lb/sec of main oxygen flow is directed to said multiplicity of individual main combustors to provide an oxygen rich environment prior to ignition of said source of pilot fuel, said source of pilot fuel is directed through said multiplicity of pilot fuel conduits at from 0.02925 to 0.04875 lb/sec into said main combustor, igniter oxygen and from 0.015 to 0.025 lb/sec of ignition fuel is directed into said precombustor plenum chamber, after 2 to 4 seconds, the unburned igniter oxygen and igniter fuel is detonated by said ignition means in said precombustor plenum chamber thus providing a combustion wave of a heat intensity between 4000° and 5000° F that propagates down each of said multiplicity of combustion wave-fuel conduits leading to said main combustors to ignite said source of pilot fuel, the igniter oxygen and igniter fuel flow is then terminated and the residual hot gases are purged by said source of inert purge gas directed into said precombustor plenum chamber, after 1 to 3 seconds the main fuel from said fuel supply manifold is turned on which drives out the purge gases and upon reaching the ignited pilot flame, said main fuel and said main oxygen flowing in said main combustors ignites, thereby providing main stage combustion of the pilot fuel source is then cut off.

3. The invention as set forth in claim 1 wherein said fuel is propane, said oxidizer is gaseous oxygen and said inert gas is nitrogen.

4. The invention as set forth in claim 1 wherein said ignition means is at least one spark plug.

5. The invention as set forth in claim 1 wherein said pilot fuel is propane.

* * * * *